US011356771B2

(12) United States Patent
Kim

(10) Patent No.: US 11,356,771 B2
(45) Date of Patent: Jun. 7, 2022

(54) SUPERDIRECTIVE SPEAKER

(71) Applicant: Hyun Chul Kim, Seoul (KR)

(72) Inventor: Hyun Chul Kim, Seoul (KR)

( * ) Notice: Subject to any disclaimer, the term of this patent is extended or adjusted under 35 U.S.C. 154(b) by 0 days.

(21) Appl. No.: 17/086,926

(22) Filed: Nov. 2, 2020

(65) Prior Publication Data

US 2021/0144468 A1 May 13, 2021

(30) Foreign Application Priority Data

Nov. 8, 2019 (KR) ..... 10-2019-0142600

(51) Int. Cl.
*H04R 1/30* (2006.01)
*H04R 1/32* (2006.01)

(52) U.S. Cl.
CPC ..... *H04R 1/323* (2013.01)

(58) Field of Classification Search
CPC ..... H04R 1/30; H04R 1/2861; H04R 1/2865; H04R 2201/34
USPC ..... 381/190, 182, 340–344
See application file for complete search history.

(56) References Cited

U.S. PATENT DOCUMENTS 8,229,141 B1 * 7/2012 Benjamin ..... B06B 1/0629 381/182
2006/0285711 A1 * 12/2006 Song ..... H04R 1/30 381/340
2007/0147647 A1 * 6/2007 Voishvillo ..... H04R 1/30 381/343
2016/0105745 A1 * 4/2016 Henry ..... G10K 11/26 381/106
2018/0054671 A1 * 2/2018 Voishvillo ..... H04R 1/30

FOREIGN PATENT DOCUMENTS

KR 10-0385388 B1 5/2003
KR 10-1574794 B1 12/2015
KR 10-1981575 B1 5/2019

* cited by examiner

*Primary Examiner* — Suhan Ni
(74) *Attorney, Agent, or Firm* — Studebaker & Brackett PC

(57) ABSTRACT

The present invention relates to a superdirective speaker, and particularly, to a superdirective speaker in which speaker units are disposed and aligned adjacent to one another, and sound outputted from the speaker units overlaps and propagates stepwise, such that the sound may be clearly transmitted over a long distance.

7 Claims, 8 Drawing Sheets

[FIG. 1]
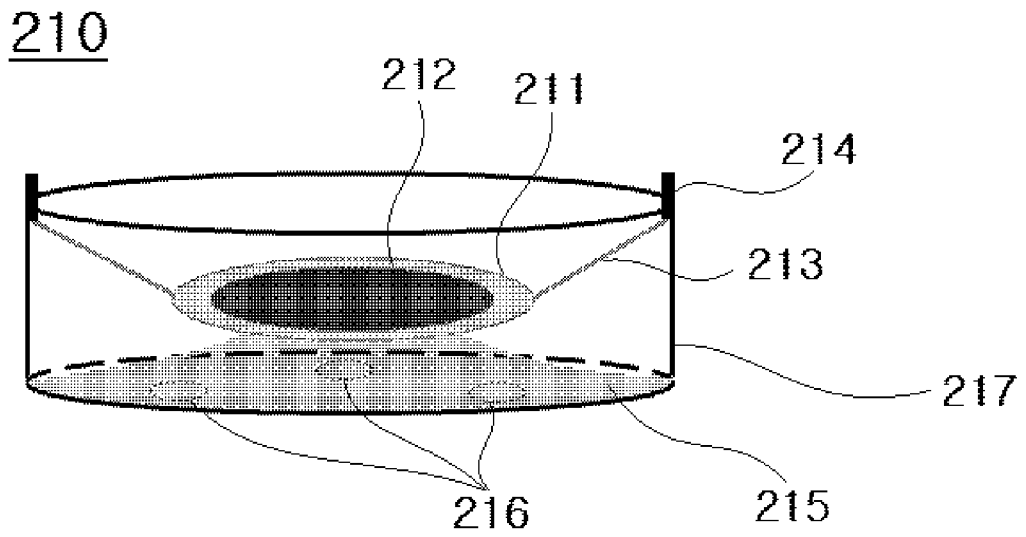
[FIG. 2]
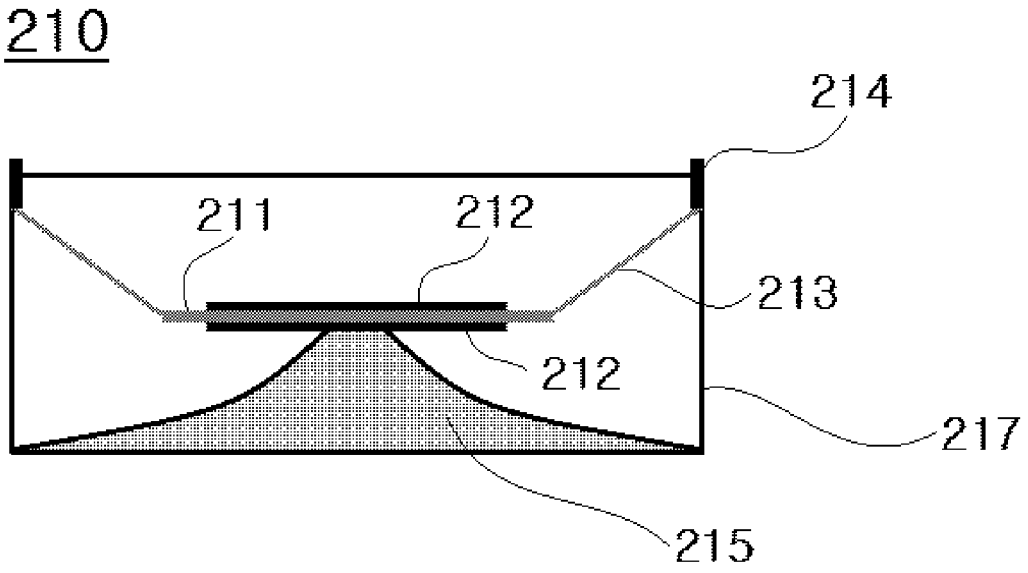

[FIG. 3]
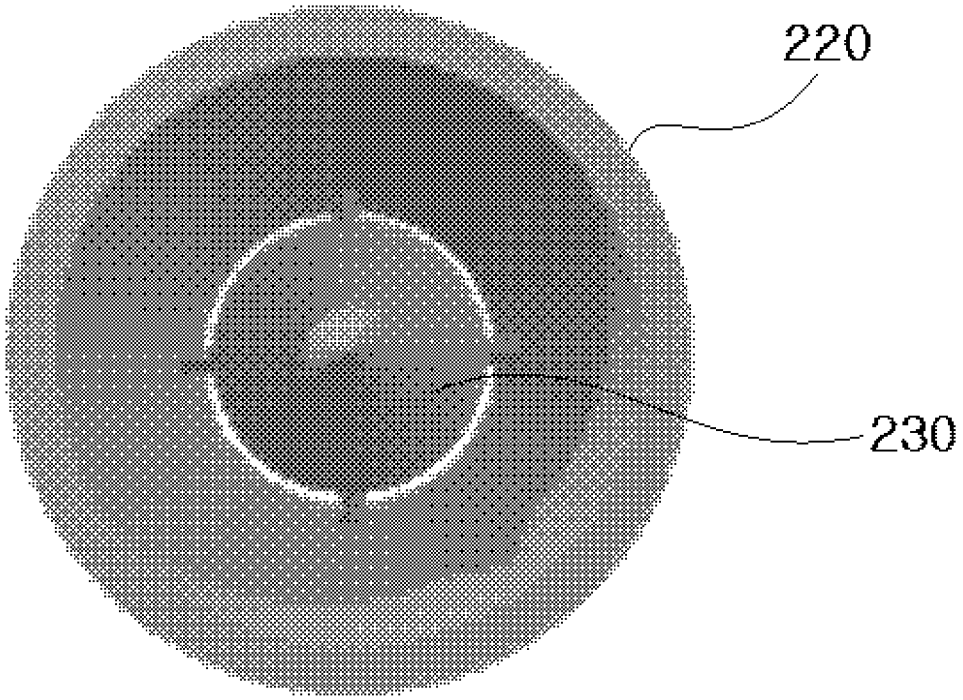

[FIG. 4]
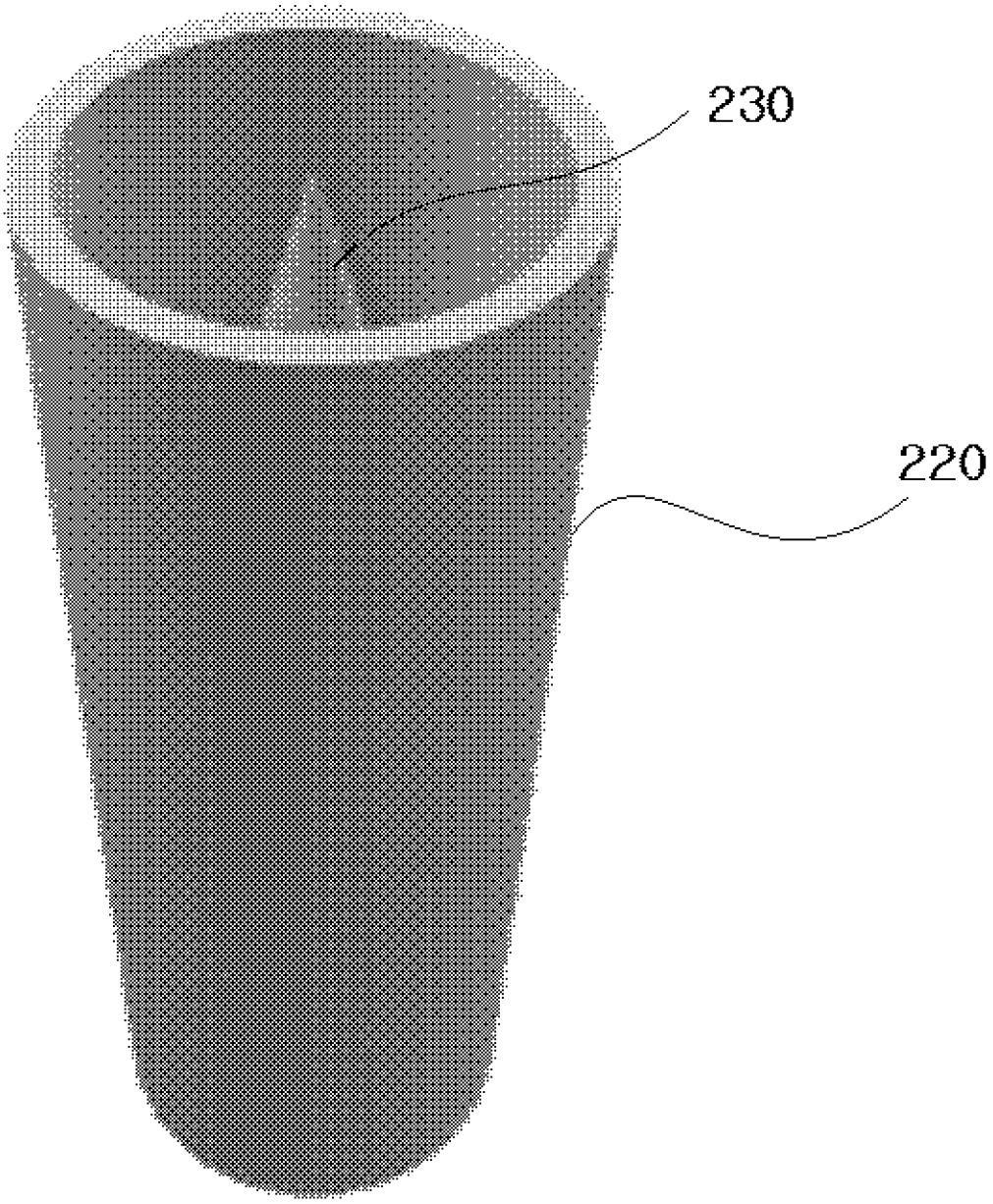

[FIG. 5]
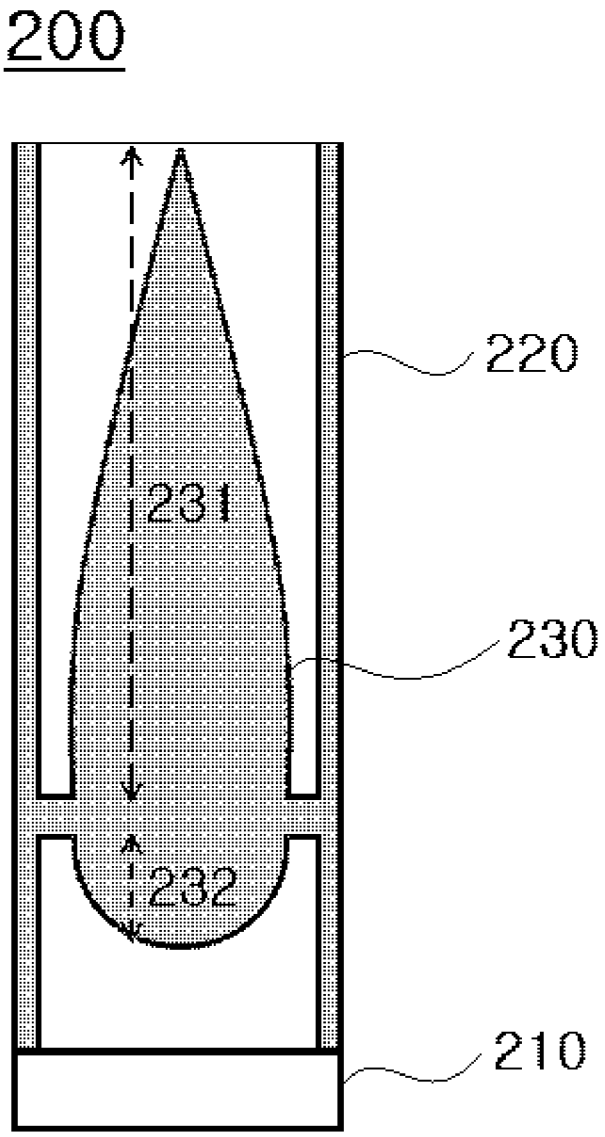

[FIG. 6]
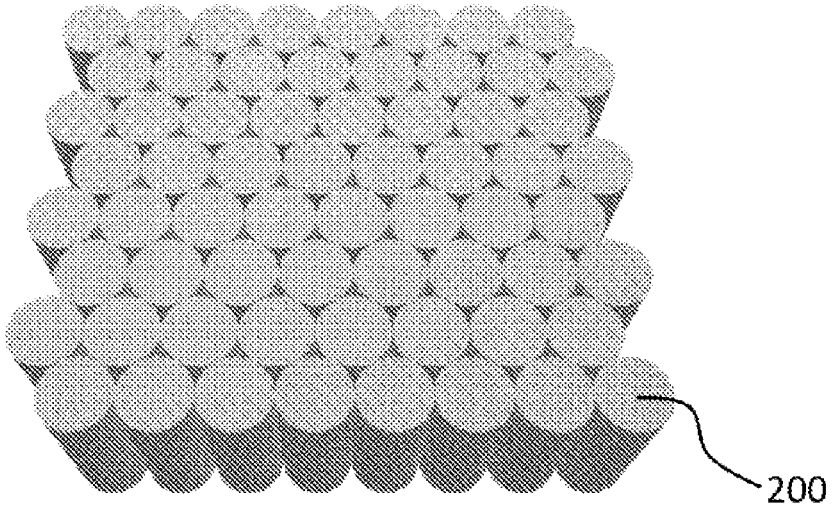

[FIG. 7]
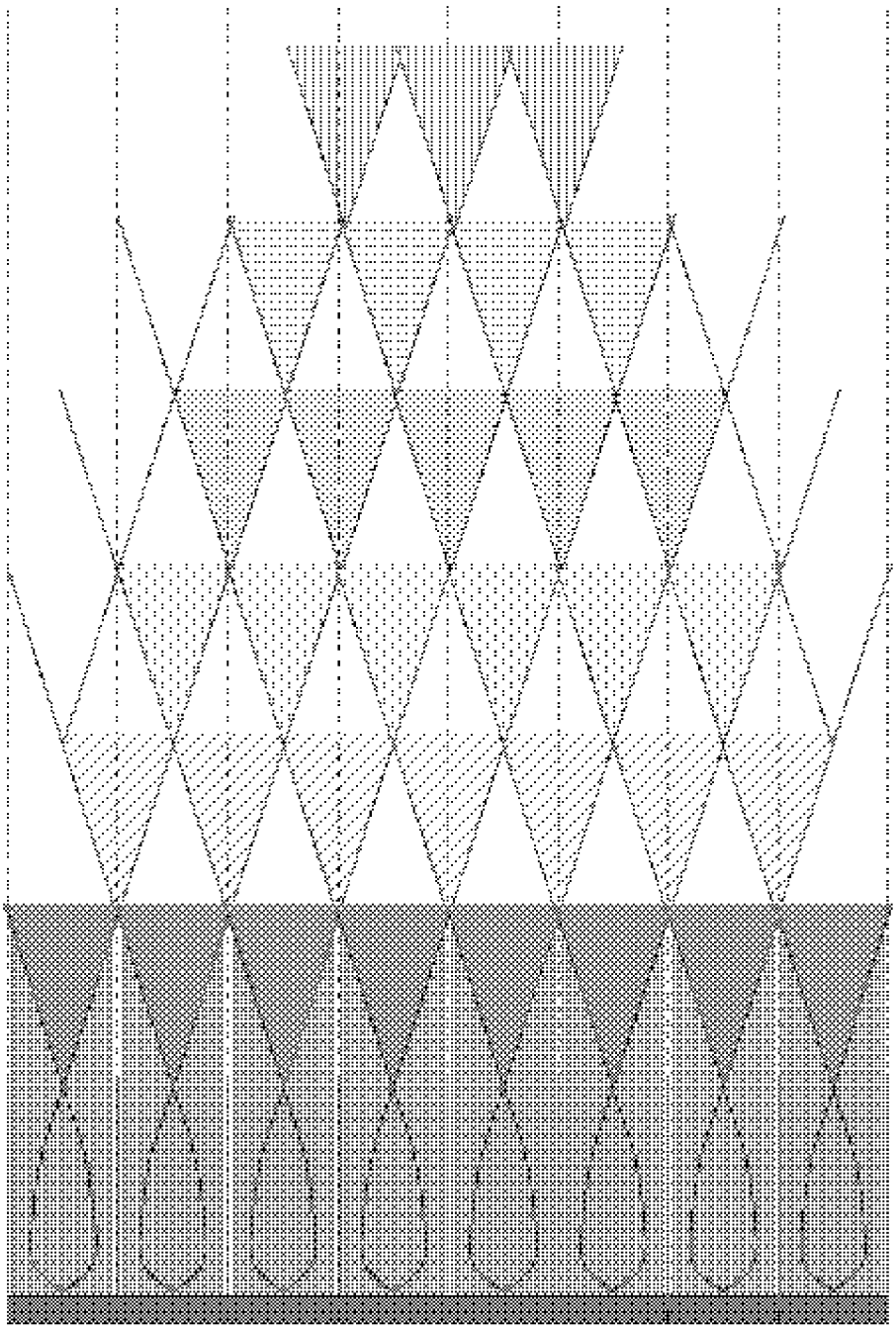

[FIG. 8]
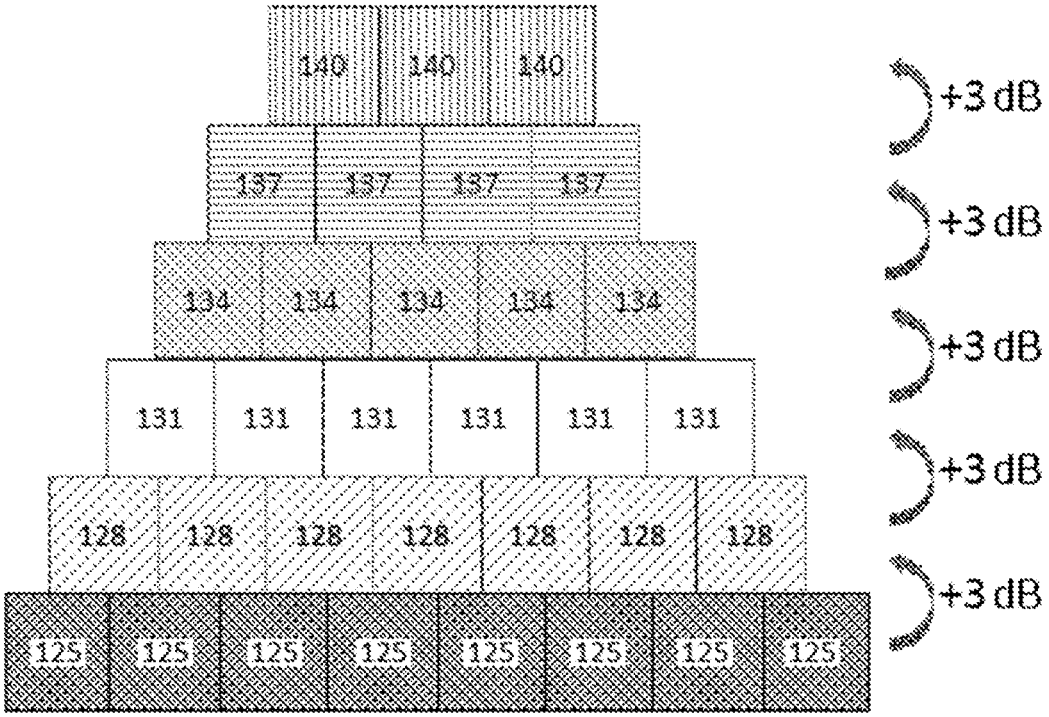

[FIG. 9]
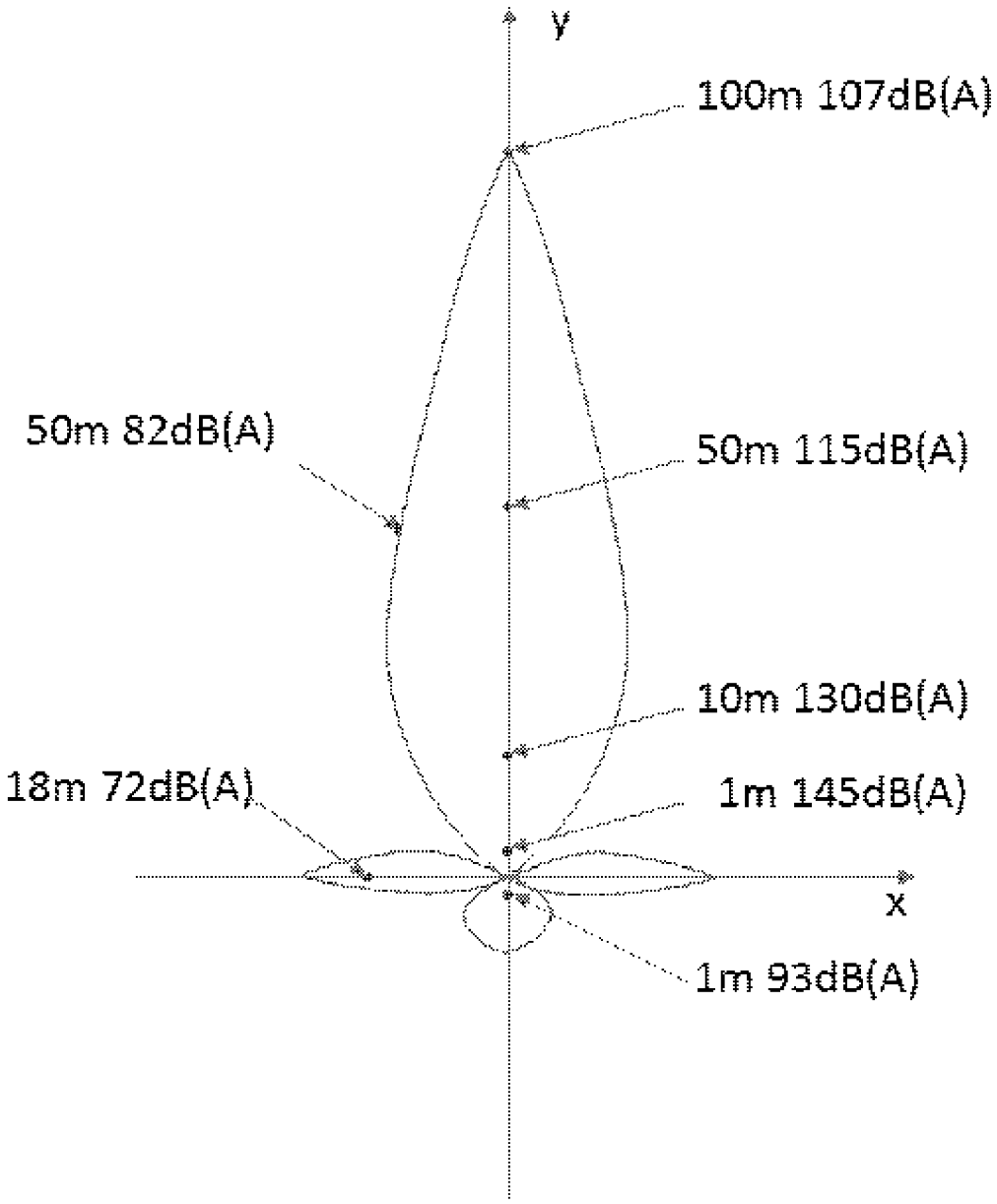

SUPERDIRECTIVE SPEAKER

CROSS-REFERENCE TO RELATED APPLICATIONS

A claim for priority under 35 U.S.C. § 119 is made to Korean Patent Application No. 10-2019-0142600 filed on Nov. 8, 2019 in the Korean Intellectual Property Office, the entire contents of which are hereby incorporated by reference.

TECHNICAL FIELD

The present invention relates to a superdirective speaker, and particularly, to a superdirective speaker in which speaker units are disposed and aligned adjacent to one another, and sound outputted from the speaker units overlaps and propagates stepwise, such that the sound may be clearly transmitted over a long distance.

BACKGROUND ART

A typical speaker transmits sound in all directions in the air. However, there may sometimes be a case in which the sound needs to be transmitted only in a certain direction, as necessary. For example, the transmission of the sound may be used for signaling in tunnels, guidance about the construction area, and use in the stadium. In this case, there is a method using a parabolic dish. A typical speaker is installed at a focal point of a dish, such that outputted sound is reflected by the dish and has straightness. However, the method requires a dish having a very large diameter and has a short reach of sound, and sound quality may be degraded due to mutual interference of the reflected sound. Accordingly, there is a need for a method capable of more clearly transmitting sound over a long distance by providing a superdirective speaker with a simpler structure in order to improve utilization.

DOCUMENTS OF RELATED ART

Patent Document

Korean Patent No. 10-1981575

DETAILED DESCRIPTION OF THE INVENTION

Technical Problem

The present invention has been made in an effort to solve the above-mentioned problems, and a superdirective speaker according to the present invention may include at least one speaker unit, in which the speaker unit includes a sound output device configured to output sound corresponding to a signal inputted from the outside, a pipe coupled to the sound output device and configured to output, the sound, outputted from the sound output device, to the outside, and a wave guide provided in the pipe and configured to guide the sound outputted from the sound output device so that the sound has predetermined directionality.

The present invention provides the superdirective speaker that may overlap, stepwise, the sounds outputted from the respective speaker units to clearly transmit the sound over a long distance, and may improve and use a piezoelectric speaker, which was used only as a buzzer in the related art, thereby greatly reducing a volume of the speaker.

Technical Solution

A superdirective speaker according to an exemplary embodiment of the present invention includes at least one speaker unit, in which the speaker unit includes a sound output device configured to output sound corresponding to a signal inputted from the outside, a pipe coupled to the sound output device and configured to output, the sound, outputted from the sound output device, to the outside, and a wave guide provided in the pipe and configured to guide the sound outputted from the sound output device so that the sound has predetermined directionality.

In the exemplary embodiment, the sound output device may output the sound by means of vibration of a vibration plate.

In the exemplary embodiment, the sound output device may be formed by attaching piezoelectric plates to both surfaces of the vibration plate.

In the exemplary embodiment, the multiple speaker units may be provided.

In the exemplary embodiment, the superdirective speaker may allow the sounds outputted from the respective multiple speaker units to overlap one another stepwise while propagating in a propagation direction.

In the exemplary embodiment, the speaker units may be aligned adjacent to one another in a predetermined arrangement structure.

In the exemplary embodiment, the speaker units may be disposed such that a distance between centers of the adjacent speaker units is minimized.

In the exemplary embodiment, the wave guide may have a predetermined shape that provides directionality to the sounds outputted from the respective aligned speaker units so that the sounds overlap one another.

In the exemplary embodiment, the wave guide may change an interval with respect to an internal space of the pipe through which the sound outputted from the sound output device passes.

In the exemplary embodiment, the wave guide may include a conical upper portion having a cutting edge positioned at a center of the pipe, and a hemispheric lower portion.

Advantageous Effects

According to the superdirective speaker according to the exemplary embodiment of the present invention, the speaker unit is configured by improving a piezoelectric speaker in the related art, such that a volume of the superdirective speaker may be greatly reduced.

The superdirective speaker according to the exemplary embodiment of the present invention may provide directionality to the sounds outputted from the respective speaker units and thus may allow the sounds outputted from the respective speaker units to overlap one another stepwise while propagating, thereby consistently maintaining intensity of the sound to a predetermined decibel or higher and clearly transmitting the sounds over a long distance without howling.

BRIEF DESCRIPTION OF DRAWINGS

FIG. 1 is an internal projection view for explaining a configuration of a sound output device 210 according to an exemplary embodiment of the present invention.

FIG. 2 is a view illustrating a cross section of the sound output device 210 according to the exemplary embodiment of the present invention.

FIGS. 3 to 5 are views for explaining a configuration of the speaker unit 200 according to the exemplary embodiment of the present invention.

FIG. 6 is a view for explaining a structure in which the speaker units 200 according to the exemplary embodiment of the present invention are arranged.

FIGS. 7 and 8 are views for explaining a process of overlapping sounds using a superdirective speaker 100 according to the exemplary embodiment of the present invention.

FIG. 9 is a graph illustrating an effect of transmitting sound outputted from the superdirective speaker 100 according to the exemplary embodiment of the present invention.

BEST MODE

Hereinafter, the present invention will be described in detail with reference to the accompanying drawings. Here, repeated descriptions and detailed descriptions of publicly-known functions and configurations, which may unnecessarily obscure the subject matter of the present invention, will be omitted. Exemplary embodiments of the present invention are provided to more completely explain the present invention to a person with ordinary skill in the art. Therefore, shapes and sizes of elements illustrated in the drawings may be exaggerated for a more apparent description.

Throughout the specification, unless explicitly described to the contrary, the word "comprise" or "include" and variations, such as "comprises", "comprising", "includes" or "including", will be understood to imply the inclusion of stated constituent elements, not the exclusion of any other constituent elements.

A superdirective speaker 100 according to an exemplary embodiment of the present invention may include at least one speaker unit 200. The speaker unit 200 may include a sound output device 210, a pipe 220, and a wave guide 230.

The speaker unit 200 may refer to a unit speaker device that constitutes the superdirective speaker 100 according to the present invention which may transmit sound outputted from the speaker in a directed particular direction farther or more clearly than a typical speaker. In the exemplary embodiment, the multiple speaker units may be provided.

FIGS. 5 and 6 illustrate a shape of the speaker unit 200 according to the exemplary embodiment of the present invention. FIG. 5 illustrates a cross-sectional configuration of the speaker unit 200, and FIG. 6 illustrates the exemplary embodiment in which the multiple speaker units 200 constitute the superdirective speaker 100. According to the exemplary embodiment illustrated in FIG. 6, the sounds outputted from the speaker units 200 may overlap one another, such that the speaker units 200 may constitute the superdirective speaker 100. In addition, a detailed method of configuring the superdirective speaker 100 by means of the configuration of the speaker unit 200 and the arrangement of the speaker units 200 will be described below.

In the exemplary embodiment, when the multiple speaker units 200 are provided, the speaker units 200 are disposed and aligned adjacent to one another in an arrangement structure.

In this regard, FIG. 6 is a view for explaining a structure in which the speaker units 200 according to the exemplary embodiment of the present invention are arranged. As illustrated in FIG. 6, according to the exemplary embodiment of the present invention, a total of sixty-four speaker units 200 are used and disposed in an 8×8 structure, and the speaker units 200 are disposed adjacent to one another in order to overlap the sounds outputted from the speaker units 200. However, the arrangement structure of the multiple speaker units 200 is not limited to the exemplary embodiment illustrated in FIG. 6, and the speaker units 200 may be aligned in an arrangement structure such as a 4×4 or 5×10 structure in accordance with necessity or purpose.

In the exemplary embodiment, the speaker units 200 may be disposed such that a distance between the centers of the adjacent speaker units 200 is minimized. Referring to FIG. 6, the speaker units 200 are disposed such that the distance between the centers of the speaker units 200 is minimized. In the exemplary embodiment illustrated in FIG. 6, each of the speaker units 200 has a cylindrical shape, and the speaker units 200 are disposed such that the distance between the centers of the adjacent speaker units 200 is minimized. However, an external shape (which may mean the pipe 220 to be described below) of the speaker unit 200 according to the present invention is not limited thereto, and the speaker unit 200 may have various shapes including a quadrangular or hexagonal column shape.

The sound output device 210 is one of the elements that constitute the speaker unit 200. The sound output device 210 may generate the sound to be outputted from the speaker unit 200.

In this regard, FIG. 1 is an internal projection view for explaining a configuration of the sound output device 210 according to the exemplary embodiment of the present invention, and FIG. 2 is a view illustrating a cross section of the sound output device 210 according to the exemplary embodiment of the present invention.

Referring to FIGS. 1 and 2, the sound output device 210 according to the exemplary embodiment of the present invention may include a vibration plate 211, piezoelectric plates 212, a conductive wire 213, a terminal 214, a film 215, sound output holes 216, and a housing 217.

In the exemplary embodiment, the sound output device 210 may output the sound corresponding to a signal inputted from the outside. Referring to FIG. 1, the sound output device 210 may receive, through a terminal 214 provided at one side of the housing 217, the signal for outputting the sound.

In the exemplary embodiment, the sound output device 210 may output the sound by means of vibration of the vibration plate 211. The signal, which is inputted from the outside through the terminal 214 provided at one side of the housing 217, may be transmitted to the vibration plate 211 through the conductive wire 213. Here, the vibration plate 211 is made of an electrically conductive material such as metal, and thus may serve to transmit the signal, transmitted through the conductive wire 213, to the piezoelectric plate 212. The piezoelectric plate 212 is configured to generate a converse piezoelectric effect. To this end, the piezoelectric plate 212 may be made of a substance such as quartz or Rochelle salt. The piezoelectric plates 212 may be attached and connected to the vibration plate 211, thereby receiving the signal. The piezoelectric plate 212 may be subjected to physical deformation including contraction and expansion based on the electrical signal received from the vibration plate 211. The vibration plate 211 is vibrated by the physical deformation of the piezoelectric plates 212, such that the sound to be outputted from the speaker unit 200 is generated.

In the exemplary embodiment, in the sound output device 210, the piezoelectric plates 212 may be attached to both surfaces of the vibration plate 211. According to the exemplary embodiment illustrated in FIG. 2, it can be ascertained that the piezoelectric plates 212 may be attached to both surfaces of the vibration plate 211. In a piezoelectric speaker in the related art, one piezoelectric plate 212 is attached to one vibration plate 211. In contrast, in the sound output device 210 according to the exemplary embodiment of the present invention, the piezoelectric plates 212 are attached to both surfaces of the vibration plate 211, such that functionality of the speaker is improved, and the superdirective speaker 100 may be implemented by the speaker units 200 each including the improved piezoelectric speaker.

In the exemplary embodiment, the sound generated by the vibration plate 211 may be propagated by the film 215 in a direction toward the sound output hole 216. The film 215 may be configured as a thin membrane. The film 215 is connected to the piezoelectric plate 212 attached to a lower end of the vibration plate 211, such that the generated sounds may be collected and propagated in a particular direction. Referring to the exemplary embodiment illustrated in FIG. 1, the sound output hole 216 may be formed in one surface of the housing and may serve to discharge the sounds, which are collected and propagated by the film 215, to the outside of the housing 217. In summary, the sound generated by the vibration plate 211 may be guided by the film 215 and outputted to the outside of the housing 217 through the sound output holes 216.

In addition, the sound output device 210 illustrated in FIGS. 1 and 2 is configured in accordance with the exemplary embodiment of the present invention. However, the constituent elements are not limited to the exemplary embodiment illustrated in FIGS. 1 and 2, and some constituent elements may be added, changed, or deleted as necessary.

The pipe 220 is coupled to the sound output device 210. The pipe 220 may output the sound, outputted from the sound output device 210, to the outside.

In this regard, referring to FIGS. 3 to 5, it can be ascertained that the pipe 220 may be coupled and connected to the sound output device 210 in the exemplary embodiment.

In the exemplary embodiment, referring to FIG. 5, the sound outputted from the sound output device 210 may be propagated while passing through the interior of the pipe 220 coupled to the sound output device 210. The pipe 220 may serve to allow the sound, which is outputted from the sound output device 210, to propagate in a direction in which the pipe 220 is directed. Therefore, with the pipe 220 included in each of the speaker units 200, the sound may propagate in the direction in which the superdirective speaker 100 according to the present invention is directed.

The wave guide 230 is provided in the pipe 220. The wave guide 230 may guide the sound outputted from the sound output device 210 so that the sound has predetermined directionality.

In this regard, referring to FIGS. 3 to 5, it can be ascertained that the wave guide 230 may be provided in the pipe 220 in accordance with the exemplary embodiment of the present invention.

In the exemplary embodiment, the wave guide 230 may have a predetermined shape that provides directionality to the sounds outputted from the respective speaker units 200 so that the sounds overlap one another. If there is no wave guide 230 in the case of the multiple speaker units 200 aligned in the predetermined arrangement structure in the exemplary embodiment of the present invention, the sounds outputted from the speaker units 200 may propagate merely straight, and the sounds may hardly overlap one another. Therefore, it is necessary to allow the sound to have components that propagate in other directions in addition to the component propagating straight. Therefore, the wave guide 230 may serve to allow the sound, outputted from the sound output device 210, to have the predetermined directionality while the sound passes through the interior of the pipe 220. In addition, the shape of the wave guide 230 is not limited to the exemplary embodiment illustrated in FIGS. 3 to 5, and the wave guide 230 may have other shapes in order to achieve an effect of overlapping the sounds which is targeted by the superdirective speaker 100.

In the exemplary embodiment, the wave guide 230 may change an interval with respect to an internal space of the pipe 220 through which the sound outputted from the sound output device 210 passes. As described above, the shape of the wave guide 230 may be variously deformed in order to achieve the effect of overlapping the sounds which is targeted by the superdirective speaker 100. Therefore, it is possible to provide directionality to the sound by the method that changes the space in the pipe 220 through which the sound outputted from the sound output device 210 passes.

In the exemplary embodiment, the wave guide 230 may include a conical upper portion 231 having a cutting edge positioned at a center of the pipe 220, and a hemispheric lower portion 232. FIG. 5 illustrates the shape of the wave guide 230 configured in accordance with the exemplary embodiment of the present invention. The upper portion 231 of the wave guide 230 may be formed in a conical shape and positioned so that the cutting edge of the upper portion 231 is placed in the pipe 220 or placed on a straight line together with the end of the pipe 220. A width (thickness) of the wave guide 230 is increased from the cutting edge of the upper portion 231 to the lower portion 232. When the width of the wave guide 230 reaches a predetermined width, the width of the wave guide 230 may not be increased any further. A connection point may be set between the upper portion 231 and the lower portion 232 of the wave guide 230 so that the wave guide 230 is fixed in the pipe 220. The lower portion 232 of the wave guide 230 is a portion with which the sound outputted from the sound output device 210 initially collides. The lower portion 232 of the wave guide 230 may have a spherical shape in order to reduce resistance that occurs when the sound propagates. Consequently, when viewing the wave guide 230 from the lateral side, the wave guide 230 may be streamlined and may have a pointed shape as the lower portion 232 is curved and the upper portion 231 becomes narrower toward the end of the upper portion 231.

FIGS. 7 and 8 are views for explaining a process of overlapping sounds using the superdirective speaker 100 according to the exemplary embodiment of the present invention.

FIGS. 7 and 8 illustrate an example of the superdirective speaker 100 including the eight speaker units 200. In a case in which initial intensity of the sound outputted from the speaker unit 200 is 125 dB, the intensity of the sound may become 128 dB as the sounds overlap one another, in a first step, in a direction in which the sounds propagate. The intensity of the sound may reach 140 dB as the sounds overlap one another stepwise through the five steps. The step-by-step overlapping of the sounds may be achieved as the sound outputted from the sound output device 210 has directionality by being guided by the wave guide 230 according to the exemplary embodiment of the present invention.

FIG. 9 is a graph illustrating an effect of transmitting sound outputted from the superdirective speaker 100 according to the exemplary embodiment of the present invention, and illustrating a result of measuring the intensity of the sound (decibel (dB)) at respective points.

More specifically, according to the exemplary embodiment of the present invention, FIG. 9 is a graph illustrating data from the result of the experiment performed in the configuration in which the sound output device 210 is configured by attaching the piezoelectric plates 212 to both surfaces of the vibration plate 211, the speaker unit 200 is configured to include the sound output device 210, the pipe 220, and the wave guide 230, and the speaker units 200 are aligned in the 8×8 arrangement structure.

Referring to FIG. 9, as can be seen from the exemplary embodiment illustrated in FIGS. 7 and 8, the superdirective speaker 100 according to the exemplary embodiment of the present invention may overlap, stepwise, the sounds outputted from the respective speaker units 200, thereby maintaining consistently high intensity (decibel (dB)) of the sounds propagating in the direction (y direction in FIG. 9) in which the superdirective speaker 100 is directed.

While the present invention has been described above with reference to the exemplary embodiments, it may be understood by those skilled in the art that the present invention may be variously modified and changed without departing from the spirit and scope of the present invention disclosed in the claims.

DESCRIPTION OF REFERENCE NUMERALS

100: SUPERDIRECTIVE SPEAKER
200: SPEAKER UNIT
210: SOUND OUTPUT DEVICE
211: VIBRATION PLATE
212: PIEZOELECTRIC PLATE
213: CONDUCTIVE WIRE
214: TERMINAL
215: FILM
216: SOUND OUTPUT HOLE
217: HOUSING
220: PIPE
230: WAVE GUIDE
231: UPPER PORTION
232: LOWER PORTION

What is claimed is:

1. A superdirective speaker comprising:
a plurality of speakers,
wherein each of the plurality of speakers comprises:
a sound output device configured to output sound corresponding to a signal inputted from the outside;
a pipe coupled to the sound output device and configured to the sound, outputted from the sound output device, to the outside; and
a wave guide provided in the pipe and configured to guide the sound outputted from the sound output device so that the sound has predetermined directionality,
wherein the plurality of speakers are aligned adjacent to one another in a predetermined arrangement structure, and
wherein the wave guide comprises:
an upper portion having a conical shape in which a peak of the conical shape is positioned at a center of the pipe; and
a lower portion having a hemispherical shape.

2. The superdirective speaker of claim 1, wherein the sound output device outputs the sound by vibrating a vibration plate.

3. The superdirective speaker of claim 2, wherein the sound output device is formed by attaching piezoelectric plates to both surfaces of the vibration plate.

4. The superdirective speaker of claim 1, which allows sounds outputted from the plurality of speakers to overlap one another stepwise while propagating in a propagation direction.

5. The superdirective speaker of claim 1, wherein the plurality of speakers are disposed such that a distance between centers of the adjacent speakers is minimized.

6. The superdirective speaker of claim 1, wherein the wave guide has a predetermined shape that provides directionality to the sounds outputted from the respective aligned speakers so that sounds overlap one another.

7. The superdirective speaker of claim 6, wherein the wave guide changes an interval with respect to an internal space of the pipe through which the sound outputted from the sound output device passes.

* * * * *